United States Patent [19]

Kooi

[11] 4,176,746

[45] Dec. 4, 1979

[54] GUSSET POUCH WITH INTEGRAL SEAL SUPPORT AND METHOD OF MAKING SAME

[75] Inventor: Edward Kooi, Jersey City, N.J.

[73] Assignee: Arvey Corporation, Chicago, Ill.

[21] Appl. No.: 923,358

[22] Filed: Jul. 10, 1978

[51] Int. Cl.[2] ..... B65D 27/32

[52] U.S. Cl. ..... 206/438; 206/484.1; 229/48 T

[58] Field of Search ..... 206/363, 438, 439, 484.1; 229/48 T, 55, 58

[56] References Cited

U.S. PATENT DOCUMENTS

| | | | |
|---|---|---|---|
| 3,070,225 | 12/1962 | Schwartz | 206/438 |
| 3,437,258 | 4/1969 | Kugler | 229/58 |
| 3,739,977 | 6/1973 | Shapiro et al. | 229/58 |
| 3,851,814 | 12/1974 | Stage | 206/439 |

*Primary Examiner*—William T. Dixson, Jr.
*Attorney, Agent, or Firm*—Dressler, Goldsmith, Clement, Gordon & Shore, Ltd.

[57] ABSTRACT

A gusseted package and method of making same are provided in which the package is formed by folding a first web along first and second, parallel spaced fold lines inwardly of each opposite side edge to produce first and second overlapping portions and then positioning a second web adjacent the first web. The first and second webs are first heat-sealed together at one end and along the sides of the package. Additionally, the inner surface of the first web is heat-sealed to the adjacent facing inner surface of one of each of the first overlapping portions in a reinforcement region spaced inwardly of the other end of the package and extending between the first and second fold lines with a peripheral boundry generally adjacent and parallel to the second fold line. The resulting heat-seal extends over the major portion of the distance between the first and second fold lines. However, the second overlapping portions of the first web are not heat-sealed to the underlying second web beneath the reinforcement region. The first and second webs are also heat-sealed to each other adjacent the other end but inwardly of the reinforcement region to provide reinforced, graspable, unsecured margin portions at the package first end.

10 Claims, 6 Drawing Figures

Fig. 1.
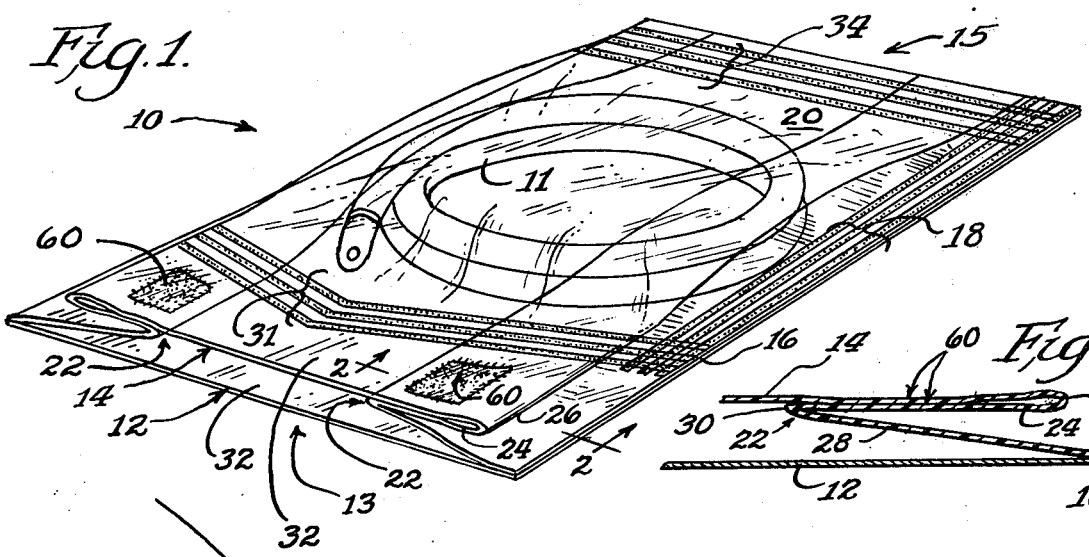
Fig. 2.
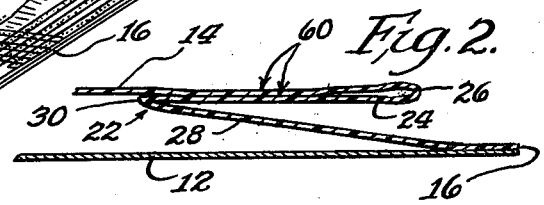
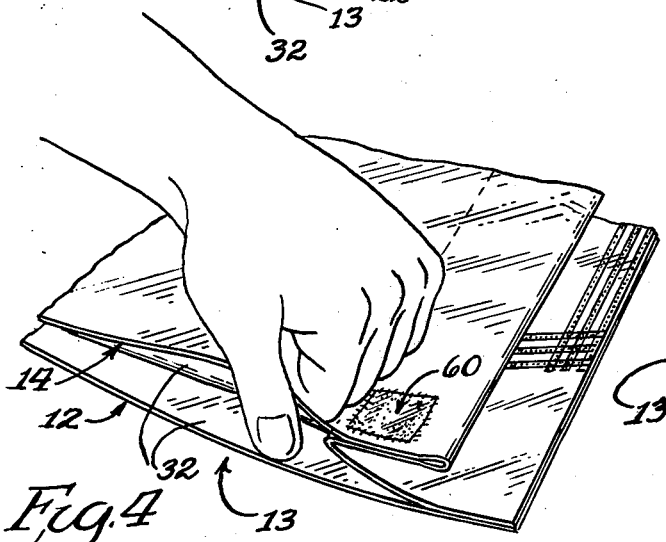
Fig. 4
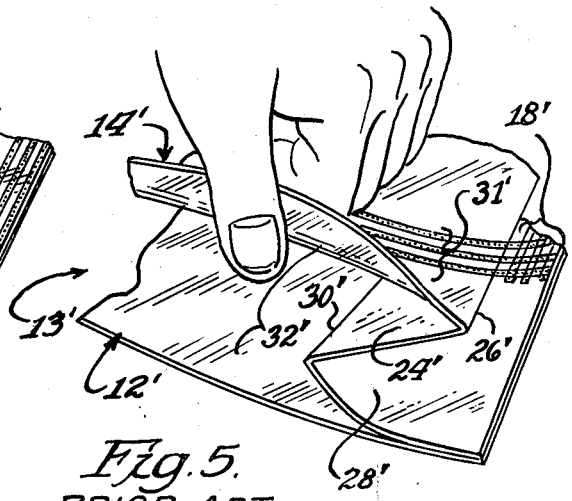
Fig. 5.
PRIOR ART
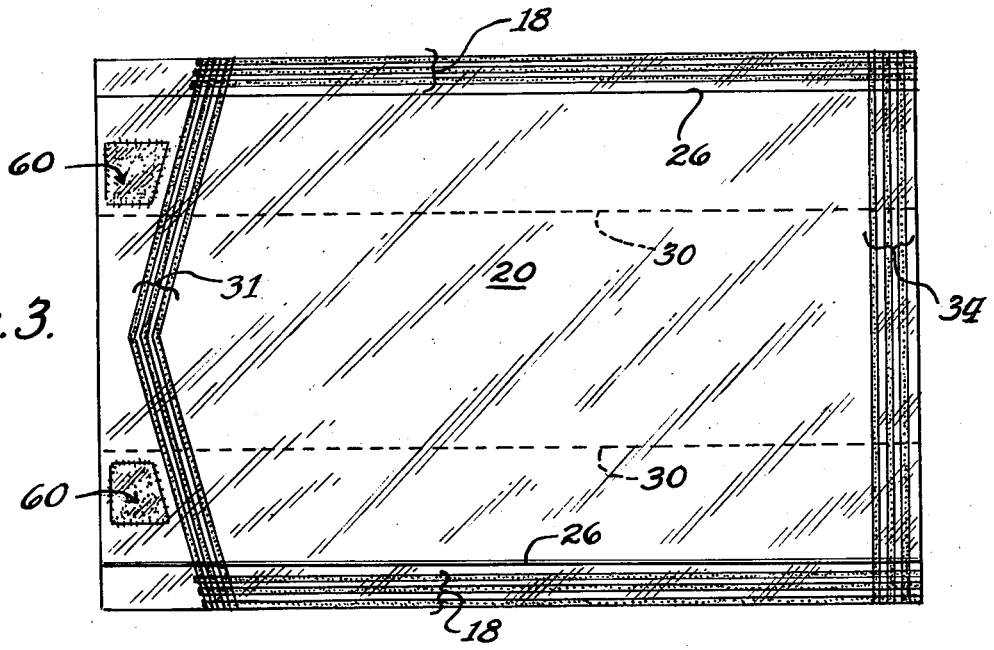
Fig. 3.

GUSSET POUCH WITH INTEGRAL SEAL SUPPORT AND METHOD OF MAKING SAME

BACKGROUND OF THE INVENTION

The present invention relates generally to packages and more particularly to an improved package and method for making such a package.

The present invention represents an improvement over the package and method of making a reopenable package disclosed in the U.S. Pat. No. 3,851,814 and the U.S. Pat. No. 3,827,341, respectively.

Packages disclosed in the above-described patents are envelope or pouch-like structures having a front and back wall. One wall is a web of transparent film composite consisting of an outer layer of polyester film and an inner layer of a heat sealable material. The other wall is a web of paper. Both ends of the pouch can be sealed closed and the closure seal at either end can be designed to be easily openable.

With closed packages made in accordance with the above-described patents, it has been found, in some applications and in some instances, that the web of film material can be ripped or torn as the package is being opened. Although the openable package closure seal in these cases usually opens also, the additional tearing of the film inwardly from the opening end of the package is undesirable for reasons that will next be explained.

Packages of the type described in the above-discussed patents are typically utilized for enclosing medical or surgical articles and the sealed pouch is then autoclaved to sterilize the article enclosed therein. Such a package can then be stored for a long period of time while the article contained therein remains sterile. During such storage, the surface of the package may become dirty and/or contaminated with bacteria. When the package is eventually opened properly, there is little chance for dirt or bacteria to be transferred from the exterior surfaces of the package to the interior. However, if the web of film-like material is torn inwardly of the openable end during the opening process, the contamination from the exterior of the film-like surface may enter the bag along the tear and contaminate the instrument.

In order to reduce the possibility of contamination of surgical instruments contained within such packages, it would be desirable to reduce the possibility of tearing the web of film-like material inwardly of the openable end seal. Further, it would be desirable to reduce the possibility of film tearing during opening of the package by providing a simple and relatively inexpensive structure in the package, which structure could be fabricated simultaneously during the normal fabrication of the bag, such as during the formation of seals which connect the film web to the paper web.

SUMMARY OF THE INVENTION

The present invention contemplates an improved gusseted package formed from first and second webs of material. The first and second webs of material are placed in an overlying, face-to-face relationship. The package is thus formed with the webs defining two walls, for example a front wall and back wall. The first web forms a gusset along each side edge of the package. The package has an extended bacteria-free shelf life and accommodates articles of varying size. When the package is opened by breaking a seal at one end and pulling one web of material away from the other web of material, the first web resists tearing along the gusset inwardly of the seal at the opening end.

The package has a first end which is sealed inwardly of the very end edge and a second end which, before an article is inserted therein, is left open. In one embodiment, the general shape of the package is rectangular with the short sides of the rectangular package being the first sealed end and the second open end.

The first web of material, in its preferred form, consists of a polyester film, such as polyethylene terephthalate film, that has one surface which has heat sealing characteristics. The heat sealing characteristics may be produced by laminating a polyolefin film, or other suitable heat sealable material, to the polyester film. In the preferred form, the second web is a surgical Kraft paper of low reading of porosity so that the article, when placed within the package, can be steam sterilized.

The first or film web has a transverse dimension between opposed marginal side edges of the package that is greater than the transverse dimension of the second or paper web. The two webs, however, have coterminous adhered marginal edges. The first web has a main body portion and an interconnecting segment between each marginal edge and the main body portion so that the first web can be moved relative to the second or paper web to accommodate articles of different size between the webs.

The interconnecting segment of the first or film web includes first and second spaced parallel fold lines adjacent each side edge to produce an inwardly extending first portion and an outwardly extending second portion in overlapping relation whereby a gusset is formed in the first web adjacent each side edge thereof. The outer area of each second portion extends outwardly beyond the adjacent first fold line whereby the outer area of each second portion is exposed at the marginal edges of the first web. The first web can be sealed to the second web along the exposed outer area of each second portion at the marginal edges of the package.

At the first or openable end of the package, a closure forming means is provided inwardly of the end edges at the first end for sealing the first and second webs together and for defining a graspable unsecured margin portion of each web adjacent the end edges at the first end. The closure forming means includes 1) a heat seal of the adjacent facing surfaces of the first and second webs between the second fold lines, 2) a heat seal of the inwardly extending first portions of the first web to the adjacent facing inner surface of the first web and 3) a heat seal securing the outwardly extending second portions of the first web to the adjacent facing surface of the second web.

To prevent the first web from being torn along the second fold line when the package is opened at the openable end, a novel reinforcing means or support seal is provided. The support seal is formed by securing the inner surface of the inwardly extending first portion of the first web to the adjacent facing inner surface of the first web. The support seal is located outwardly of the second fold lines between the first end of the package and the closure forming seal at the first end of the package.

The method for producing the package consists of folding a first web along spaced fold lines to produce first and second overlapping portions with the first fold lines spaced inwardly from the respective marginal edges to expose a portion of the first web beyond the first fold lines. The second web is placed in position adjacent the first web with the overlapping portions located between the webs and the webs are heat sealed to each other along exposed portions of the first web to produce a gusseted tube.

At the same time the side edges of the package are heat sealed, the heat sealing member is also brought into contact with the portion of the package inwardly of the end edge at the openable end of the package and outwardly of the second fold line to form the support seals. Subsequently, the closure forming means across the openable end of the package is formed by heat sealing the adjacent facing surfaces of the first and second webs between the second fold lines, by heat sealing the inwardly extending first portions of the first web to the adjacent facing inner surface of the first web, and by heat sealingly securing the outwardly extending second portions of said first web to the adjacent facing surface of the second web.

When a package of the type described with the reinforcing seal is then opened by grasping the graspable margin portions of each web adjacent the first end edges, it has been found that the film web does not tear along the second fold line. Rather, the closure forming seal across the openable end of the bag peels apart as the first and second webs are pulled outwardly from each other without any tears occurring in the gusset of the film web.

Thus, it is seen that the combined effect of the various elements associated in accordance with the present invention is greater than the sum of the several effects of those elements taken separately. The novel combination of elements in accordance with the present invention yields desirable, beneficial and synergistic results—results which, though unusual and surprising, are also a substantial improvement over the prior art.

Numerous other advantages and features of the present invention will become readily apparent from the following detailed description of the invention and of one embodiment thereof, from the claims and from the accompanying drawings.

BRIEF DESCRIPTION OF THE DRAWINGS

In the accompanying drawings forming part of the specification, and in which like numerals are employed to designate like parts throughout the same, FIG. 1 is a perspective view of a completely sealed package of the present invention with the contents enclosed therein;

FIG. 2 is an enlarged fragmentary cross-sectional view taken generally along the plane 2—2 of FIG. 1;

FIG. 3 is a plan view of the package of FIG. 1 without the article enclosed therein;

FIG. 4 is a fragmentary, perspective view of the package of FIG. 1 being opened;

FIG. 5 is a fragmentary, perspective view of a prior art package, such as that disclosed in U.S. Pat. No. 3,851,814, being opened.

DESCRIPTION OF THE PREFERRED EMBODIMENT

Figure 6:
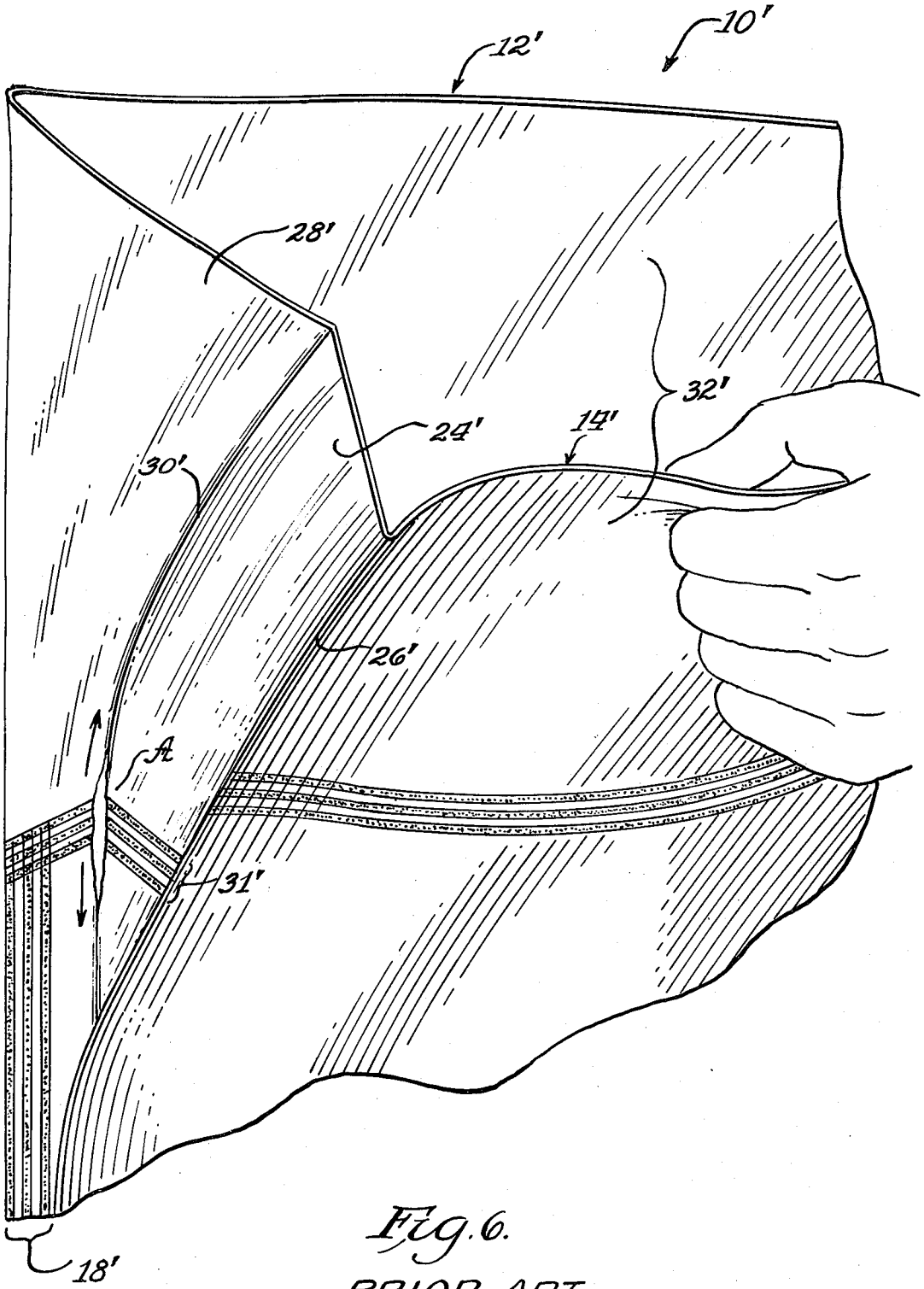
Fig. 6. PRIOR ART
FIG. 6 is an enlarged, fragmentary, perspective view of a prior art package, such as that disclosed in U.S. Pat. No. 3,851,814, being opened and further illustrating the propagation of a tear within the package.

While this invention is susceptible of embodiment in many different forms, there is shown in the drawings and will herein be described in detail one specific embodiment, with the understanding that the present disclosure is to be considered as an exemplification of the principles of the invention and is not intended to limit the invention to the embodiment illustrated.

The precise shapes and sizes and relative positions of the elements of the invention herein described are not essential to the invention unless otherwise indicated, since the invention is described with reference to an embodiment which is simple and straightforward.

FIG. 1 shows a package 10 in accordance with the present invention with a medical apparatus 11 enclosed therein. The package consists of first and second webs of material 14 and 12, respectively, which are placed together to form the front and back walls, respectively, of a pouch having a generally rectangular configuration with an openable first end 13 and a permanently heat sealed second end 15.

The first web 14 has a transverse dimension between opposite marginal side edges 16 that is greater than the transverse dimension between the marginal edges of the second web 12 while the two webs are interconnected along the area generally designated at 18 in FIG. 1 and will be described in more detail hereinafter.

With reference now to both FIGS. 1 and 3, it is seen that the first web 14 consists of a main body portion 20 that is substantially co-extensive in width to the width of the second web 12 and has two interconnecting segments 22 respectively located between the marginal edges 16 and the opposite sides of the main body portion 20. The interconnecting segments 22, as best illustrated in FIG. 2, each consist of an inwardly extending first portion 24 secured to the main body 20 along a first fold line 26 and an outwardly extending second portion 28 in overlapping relation to the first portion 24, which outwardly extending second portion 28 is located between a second fold line 30, parallel to and spaced from the first fold line 26, and the marginal edge 16.

As more clearly shown in FIGS. 2 and 3, the first fold lines 26 are located inwardly of the marginal edges 16 of the first web 14 so as to expose an outer portion of the upper surface of the outwardly extending second portion 28 which is secured, as will be explained in detail hereinafter, to the first web 12 along the marginal edges 16 by seal 18.

By proper selection of the materials for the two webs an extremely practical product can be produced that will have an extended shelf life. Preferably, the first web 14 is a polyester film having a coating or laminate of heat sealing material, such as a polyolefin film, on the inner surface thereof. Such a material is transparent and will allow the interior and contents of the package to be inspected. The second web 12 preferably is a surgical Kraft paper of low reading of porosity which will pass steam. These two webs can be secured by a heat seal where necessary as will be explained below.

Preferably, the first and second webs 14 and 12, respectively, are secured along the side edges 16 by heat sealing, as by engaging a suitable heat sealing member on the exterior of the first web or film 14 and pressing the package against a suitable die supporting the back or exterior surface of the second or paper web 12. A localized melting of the heat sealable film on the inner surface of the first web 14 will cause a heat seal weld to be formed between the two webs. The heat seal weld may have any suitable configuration. The configuration illustrsted in the figures consists of three spaced apart, parallel bands. Instead of three separate parallel bands, just one band could be used.

After the side margins 16 of the webs 14 and 12 are sealed, the openable end 13 of the package may be similarly sealed by engaging a suitable heat sealing member on the exterior surface of the paper web 12 and transferring heat through the paper to the film web to form the heat seal weld closure 31.

The heat seal weld closure 31 includes 1) a heat seal of the adjacent facing surface of the first and second webs 14 and 12, respectively, across the package between the two second fold lines 30, 2) a heat seal of the inwardly extending first portions 24 of the first web 14 to the adjacent facing inner surface of the body 20 of the first web 14 and 3) a heat seal securing the outwardly extending second portions 28 of the first web 14 to the adjacent facing surface of the second web 12. When using a polyester film, such as polyethylene terephthalate, that has a coating or laminate of heat sealable material only on the one interior surface thereof, the facing surfaces of the exterior of the film web 14 will not adhere to each other during the heat sealing of the web. Pressure applied during heat sealing will cause the two webs 14 and 12 to adhere directly to each other between the two second fold lines 30, while the first overlapping portions 24 are secured to the main body portion 20 of the first web and while the outwardly extending second portions 28 are secured to the paper second web 12. However, since the exterior surface of the film web 14 does not have heat sealing characteristics, the exterior surfaces of the overlapping portions 24 and 28 are free of any interconnection between the second fold lines 30 and the marginal edges 16.

The heat seal closure 31 is spaced at the first or openable end 13 of the package inwardly of the end edges to define graspable, unsecured margin portions 32. These margin portions 32 may later be grasped and pulled apart to open the package.

Typically, after the package 10 is formed with the heat sealing closure 31 securing the openable end 13 of the bag and with the side edges 16 of the bag secured together, the package 10 is then shipped to a user facility, such as a hospital, where a piece of medical apparatus or surgical instrument, such as apparatus 11, is inserted into the package 10 from the second, but still open, end 15. The end 15 may then be secured, as by heat sealing, with heat seal welds 34.

When it is later desired to open the package 10 to use the medical apparatus 11, the first or openable end 13 of the package 10 is opened by grasping the first and second webs 14 and 12, respectively, at the graspable unsecured margin portions 32 and then pulling the margin portions 32 of the first and second webs outwardly relative to each other to tear away the closure seal 31.

As illustrated in the drawings, especially in FIGS. 4, 5, and 6, the package 10 is shown being opened by pulling the film first web 14 away from the paper second web 12. Generally, the paper second web 12 would also be grasped with the other hand. Preferably, the paper second web has specific instructions, including direction arrows, printed thereon indicating that one is to "peel down" the paper web relative to the film web. In any case, the resulting relative movement between the two webs, as one or both of the webs are pulled relative to the other, is identical. For simplicity in the drawings, the pouch is illustrated as being opened by pulling on the first film web. It is to be understood that, in general, both webs must be grasped and that the paper web may be pulled down and away from the film web while the film web is held stationary.

To prevent the first or film web 14 from tearing in the gusset area when the package 10 is so opened, a novel reinforcing means or support seal 60 is provided on each side of the package 10 in the first or film web 14. Preferably, the reinforcing means or support seal 60 secures the inwardly extending first portion 24 to the adjacent facing inner surface of the film web body portion 20 outwardly of the second fold line 30 and between the closure 31 and the end edges at the openable end 13 as best illustrated in FIGS. 2 and 3. Preferably, the support seal 60 is a heat seal weld of the film 14, which weld extends outwardly from adjacent the second fold line 30 for a distance greater than one half of the width of the inwardly extending first portion 24.

Experiments on production packages have shown that it indeed functions as intended to inhibit tearing. FIGS. 5 and 6 illustrate a portion of a package, similar to package 10 illustrated in FIG. 1 and described above, but without the support seal 60. The other structural elements of the package are identical to those of the package 10 and are designated with corresponding, but primed, numerals.

When the package 10', not having a support seal, is opened as illustrated in FIG. 5, it can be seen that the overlapping portions of the first film web 14' separate as would be expected in the region of the graspable unsecured margin portions 32'. That is, the outwardly extending second portion 28' is pulled outwardly away from the second web 12', the first inwardly extending portion 24' is pulled outwardly away from both the second web 12' and the second outwardly extending portion 28', and lastly, the adjacent area of the main body 20 of the first web 14' pulls outwardly from the first inwardly extending portion 24'. Now, with reference to the enlarged view of FIG. 6, it can be seen that as the package is further opened by pulling the graspable unsecured margin portions 32 further apart, a tear begins to propagate at point A at the outer edge of the closure means 31' along the second fold line 30'. The tear propagates outwardly along the second fold line 30' to the edge of the openable end 13' and also propagates down the package through the closure heat seal weld 31' and continues downwardly along the second fold line 30'. The tear may also "branch off" from the second fold line 30' into the first portion 24' towards the first fold line 26'. In any case, the portion of the tear extending inwardly of the closure weld 31' provides an unwanted opening into the interior of the package through which dirt from the exterior surfaces of the film web 14' may pass and cause contamination of the medical apparatus within the package.

Surprisingly, it has been found that the above-described reinforcing means or support seal 60 effectively prevents the tear from forming in the region of the pouch illustrated in FIG. 6 and described above. With reference now to the preferred embodiment illustrated in FIGS. 1 through 3, one explanation has been offered to describe the manner in which the support seal 60 effectively prevents tearing of the first film web 14 during opening. It is believed that the support seal 60 (defined by the securement of the inwardly extending first portion of the first web to the adjacent facing inner surface of the first web in the region adjacent the closure means seal and the second parallel fold line), synergistically cooperates with the folded web pouch structure to reduce the stress in the region. In any case, it has been found that the reinforcing securement 60 need not extend between the overlapping inwardly extending first portion 24 and the overlapped outwardly extending second portion 28 in order to be effective. This is significant because, when using a film 14 having a heat sealable coating only on the inner surface, it is not possible to provide a heat seal weld on the exterior surfaces of the film between the exterior surfaces of the overlapping inwardly first extending portions 24 and the outwardly extending second portions 28.

It has been found preferable to form the reinforcing or support seal 60 as a heat seal weld simultaneously with the formation of the side margin heat seal welds 18. Typically, in one embodiment, the side margin heat seal weld 18 and the support seal welds 60 are formed by pressing a heated sealing member on the exterior of the first film web 14 with a suitable die against the exterior of the second paper web 12. By exercising proper control of impression temperatures, pressures, and dwell times, the support seal 60 can be made but the heat sealable coating on the inner surface of the outwardly extending second portion 28 will not be heat sealed to the second web 12 directly below the support seal.

The closure forming seal 31 across the first, openable end 13 of the package is next made. For this seal, however, a heated sealing member can be contacted with the exterior surface of the second, paper web 12, rather than with the film web 14.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. A two-ended, tear resistant, gusseted package sealed inwardly of a first end and open at a second end for receiving an article therein and which can be subsequently closed at the second end, said package comprising:

first and second webs of material, said first web having a transverse dimension greater than the second web, said webs having first end edges at said package first end and second end edges at said package second end, said webs further having closure forming means at said first end of said package spaced inwardly of said first end edges for sealing said webs at said first end and thereby defining graspable unsecured margin portions of each web adjacent said first end edges, said webs further having a pair of substantially coterminous opposed side edges, said first web having first and second spaced parallel fold lines adjacent each side edge to produce an inwardly extending first portion and an outwardly extending second portion in overlapping relation whereby a gusset is formed in said first web adjacent each side edge thereof;

means for adhering said first web to said second web to form a seal adjacent the two side edges of said first and second webs;

said closure forming means including 1) means sealing the adjacent facing surfaces of said first and second webs between said second fold lines, 2) means sealing said inwardly extending first portions of said first web to the adjacent facing inner surface of the first web, and 3) means securing the outwardly extending second portions of said first web to the adjacent facing surface of said second web; and reinforcing means securing the inner surface of said inwardly extending first portions of said first web to the adjacent facing inner surfaces of said first web, said reinforcing means being disposed between said package first end and said closure forming means outwardly of said second fold lines over the major portion of the distance between said first and second fold lines and being disposed with peripheral boundaries generally parallel to said second fold lines for increasing the tear resistance of said first web when said first and second webs are grasped at said graspable margin portions and pulled outwardly relative to each other.

2. The package in accordance with claim 1 in which said first end edges of each web are substantially coterminous.

3. The package in accordance with claim 1 in which said second end edges of each web are substantially coterminous.

4. The package in accordance with claim 1 in which said reinforcing means secures said inwardly extending first portions to said adjacent facing inner surface of the first web outwardly from said second fold line for a distance greater than the one-half of the width of said first portion.

5. The package in accordance with claim 1 in which said first web of material comprises a film which is heat sealable at least in the regions of said reinforcing means and in which said reinforcing means includes a heat seal weld of said film.

6. The package in accordance with claim 5 in which said first web of material comprises a film which is heat sealable on one side surface and in which said closure forming means is a chevron shaped heat seal weld between said first and second webs with the apex of the chevron disposed substantially midway between said side edges and closer to said first end edges than the rest of the chevron.

7. A method of connecting two webs to provide a two-ended, gusseted package having two opposed side edges and which is closed inwardly of a first end to provide reinforced, graspable, unsecured margin portions of each web adjacent the first end edges for facilitating the opening of said closed first end, said method comprising the steps of:

A. folding a first web along first and second spaced fold lines inwardly of each opposite side edge of said first web to produce first and second overlapping portions with the first fold lines spaced inwardly from the respective side edges and the second fold lines located inwardly of the first fold lines;

B. positioning a second web adjacent the first web with said overlapping portions located between said webs and said first web second overlapping portions in contact with said second web, said first web having heat sealing characteristics on the side facing said second web;

C. heat sealing said first and second webs to each other outwardly of said first fold lines along the side edges of each web to produce a gusseted tube;

D. heat sealing the inner surface of the first web to the adjacent facing inner surface of one of each of said first overlapping portions in a reinforcement region spaced inwardly of the package first end and between said first and second fold lines with a peripheral boundary generally adjacent and parallel to said second fold line and with the resulting heat seal extending over the major portion of the distance between said first and second fold lines without applying enough heat to heat seal the second overlapping portions of the first web to the underlying second web beneath said region; and E. heat sealing the first and second webs to each other across the width of the webs adjacent said package first end but inwardly of said reinforcement region to close said first end and provide said reinforced, graspable, unsecured margin portions adjacent the first end edges of each web.

8. The method in accordance with claim 7 in which said step D includes applying a heated sealing member to the first web and in which the temperature, pressure, and duration of contact of the sealing member are controlled to effect a heat sealing of only said first web and said adjacent first overlapping portion to form a reinforcing support seal in said reinforcement region.

9. The method in accordance with claim 7 in which steps C and D are performed substantially simultaneously.

10. The method in accordance with claim 7 in which said step E includes applying a heated member to said second web.

* * * * *